United States Patent [19]

Fukui et al.

[11] Patent Number: 5,005,517

[45] Date of Patent: Apr. 9, 1991

[54] DEVELOPING DEVICE

[75] Inventors: Kazuyuki Fukui; Yoshihiro Hattori; Yoshinobu Hada, all of Osaka, Japan

[73] Assignee: Minolta Camera Kabushiki Kaisha, Osaka, Japan

[21] Appl. No.: 376,411

[22] Filed: Jul. 6, 1989

[30] Foreign Application Priority Data

Jul. 6, 1988 [JP] Japan ..... 63-169902
Jul. 6, 1988 [JP] Japan ..... 63-169903
Jul. 6, 1988 [JP] Japan ..... 63-169905
Jul. 6, 1988 [JP] Japan ..... 63-169906

[51] Int. Cl.[5] ..... G03G 15/08; G03G 15/01

[52] U.S. Cl. ..... 118/689; 118/657; 355/246; 355/251; 355/253; 355/326

[58] Field of Search ..... 355/246, 251, 253, 326-328; 118/656-658, 688-691

[56] References Cited

U.S. PATENT DOCUMENTS 4,461,238 7/1984 Baier et al. ..... 355/253 X
4,583,843 4/1986 Ohata et al. ..... 355/253
4,700,659 10/1987 Hirakura et al. ..... 355/253 X
4,707,107 11/1987 Joseph ..... 355/253
4,711,551 12/1987 Fujio et al. ..... 355/3 DD
4,721,982 1/1988 Ueda ..... 355/253 X
4,731,632 3/1988 Fukushima et al. ..... 355/253 X
4,742,370 5/1988 Murakami et al. ..... 355/253
4,814,820 3/1989 Hirahara et al. ..... 355/253
4,878,088 10/1989 Nakanishi et al. ..... 355/253 X

FOREIGN PATENT DOCUMENTS 61-217072 9/1986 Japan .
62-8176 1/1987 Japan .
62-28780 2/1987 Japan .

*Primary Examiner*—R. L. Moses
*Attorney, Agent, or Firm*—Willian Brinks Olds Hofer Gilson & Lione

[57] ABSTRACT

The transporting speed of a developer transporting roller is switched over depending on the condition whether a developing unit is operated for developing process or the developing unit is not in action for developing operation, and a comparable standard value for making a decision whether toner replenishment is required or not is changed based on the toner density value detected by a magnetic sensor when the developing unit is operated or is not in action for developing operation. When the developing unit has finished a predetermined number of operations, and image forming operation is suspended, a developer stirring and transporting roller is driven for a duration of time corresponding to the number of developing operations conducted, and toner density detection and toner replenishment is carried out corresponding to the toner density detected.

28 Claims, 9 Drawing Sheets

Fig.4(a)
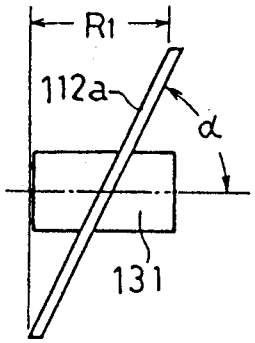
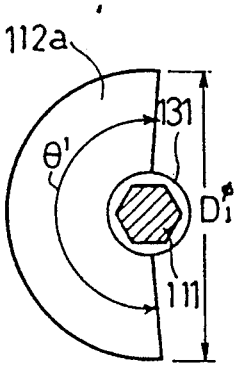
Fig.4(b)
Fig.5(a)
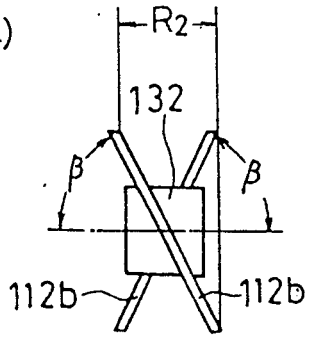
Fig.5(b)
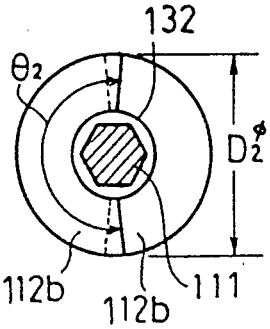
Fig.6
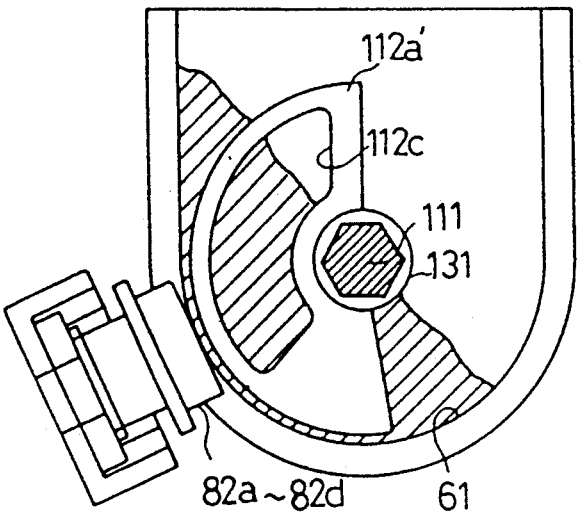
Fig7
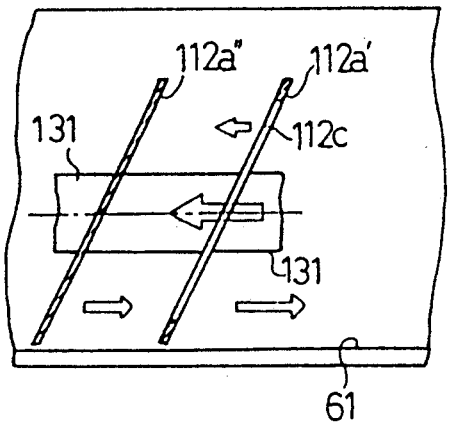

DEVELOPING DEVICE

BACKGROUND OF THE INVENTION

1. Field of the Invention

The present invention relates to a developing device for use in an electrophotographic image forming apparatus such as copying machine and laser beam printer, and more particularly, to a developing device wherein a two-component developer is used.

2. Description of Related Art

In this kind of developing device, it is generally arranged to make the toner density of the developer, that is, the amount of toner to carrier, uniform and to have the toner to be frictionally electrified properly. It is further arranged to supply a part of the toner for a developing process at a midway point in a path of circulation in which the developer is stirred and transported.

On the other hand, it is preferred that the density of the visual image after development be maintained constant in relation to a specified density set. However, the density of toner is lowered every time when the developer is used for development thereby causing the density of the image to be lowered.

Japanese Patent Publication TOKKAI SHO 62-28780 discloses a developing apparatus which solves the problem. The apparatus is arranged to detect toner density or visual image density after development by a density detecting means and replenish toner to the developer being circulated and transported when the detected density is below a predetermined value, which has heretofore been practised.

However, when toner is replenished in accordance with the shortage of toner density, it results in uneven toner density and shortage of electrification if the toner is not stirred sufficiently and causes irregularity of image and shortage in image density. It is, therefore, considered to continue transporting developer even after the developing process is finished. However, it may cause to worsening of the quality of developer by excessive stirring if the developing apparatus is simply kept on driving. Besides, it consumes considerable electricity and causes high noise even when the developing process is suspended.

When a color image is formed, the density of the original, that is, the ratio between black and white on the surface of the original, is as high as 50–80% compared to that of an ordinary image which is below 25% and considerable amount of toner is consumed. Accordingly, the amount of toner to be replenished to the developer being stirred and transported is necessarily increased. However, if a large amount of toner is replenished, the toner can not be sufficiently stirred before it reaches the position of development and causes irregularity in toner density and an uneven image since the distance from a toner replenishing inlet to the position of development in a path of circulation is limited in practical design.

Japanese Patent Publication TOKKAI SHO 62-8176 discloses a developing apparatus which deals with the problem described above. The apparatus is arranged to vary transporting speed distribution by providing notch portion on a transporting lead member in a stirring and transporting means. Such arrangement raises stirring efficiency since the flow of developer is varied with variation of transport speed in the transporting direction.

However, the variation in the speed of transportation of developer in the transporting direction can only provide slow and fast movement partially in the flow of the developer, and sufficient stirring for repeatedly and positively replacing developer over all portions can not be achieved. In the case when a large amount of toner is replenished for color image development, the developer which has received the toner can not make the density sufficiently uniform, and further improvement is required. Furthermore, in detecting the toner density by a sensor, if the amount of developer in the density detecting portion is not secured at a predetermined value, the density detected differs from actual value and there arises a scatter in the value.

U.S. Pat. No. 4,711,551 discloses an apparatus which deals with the problems described above. The apparatus is arranged to store developer in a density detecting portion by providing an interrupted portion opposite to the density detecting portion.

However, it is necessary to successively renew the developer stored therein in order to be able to continuously detect toner density in each portion since the developer is stored in the density detecting portion without having been stirred or transported. There is only one way to surely push forward the stored developer by the developer following. In order to surely push forward the developer, it is necessary to transport all the developer with transporting force in all areas of circulation when the developer is transported, however, it causes the stirring efficiency to be lowered and tends to cause irregularity in toner density and insufficient electrification.

SUMMARY OF THE INVENTION

A primary object of the present invention is to provide a developing device which is able to always form a high quality image by showing stable developing characteristics.

Another object of the present invention is to provide a developing device capable of solving the problems of irregularity of toner density and shortage of electrification by fully stirring the developer, wherein a developer transport section is continuously driven for a predetermined period of time at a lower speed than the speed of developing process when developing operation is finished without inviting excessive stirring by making use of the time when the developing device is suspended in its developing operation.

A further object of the present invention is to provide a developing device which is able to prevent the developing procedure of the device from being affected by irregularity of toner density and shortage of electrification which temporarily occurs when toner is replenished while the developing device is operated. When a development for the number of sheets predetermined for image formation is finished, toner is replenished corresponding to the amount of toner consumed in the image forming process by continuously driving a developer transport section and toner replenishing system for the period corresponding to the time used for the image forming operation. By making use of the time when the developing device is suspended in its developing operation, proper toner replenishment and stirring are carried out thus recovering uniform density and sufficient electrification.

Still another object of the present invention is to provide a developing device which is capable of performing a developing procedure by fully stirring developer in a short period of time, wherein a developer stirring and transporting system is provided with a strong backward transporting force to make the flow of developer in the system complicated to carry out sufficient stirring of developer.

A still further object of the present invention is to provide a developing device which is capable of making judgment accurately whether toner replenishment is required or not by properly detecting toner density, wherein the amount of developer being transported is temporarily increased in a toner density detecting section so that the developer is transported at less volume by reducing its transporting speed.

These and other objects and features of the present invention will become more apparent from the following description taken in conjunction with the preferred embodiments thereof with reference to the accompanying drawings.

BRIEF DESCRIPTION OF THE DRAWINGS

FIGS. 4(*a*) and (*b*) are front and side views of a rotary blade which transports developer in a regular direction.

FIGS. 5 (*a*) and (*b*) are front and side views of a rotary blade which moves developer backward.

FIGS. 6 and 7 are a transverse sectional view and a longitudinal sectional view of a section where a toner density detecting sensor is installed.

It is to be noted that the second embodiment of the present invention will be described by using the same drawings used in the first embodiment of the present invention.

DESCRIPTION OF THE PREFERRED EMBODIMENTS

Embodiments of the present invention will now be described below referring to accompanying drawings.

Figure 1:
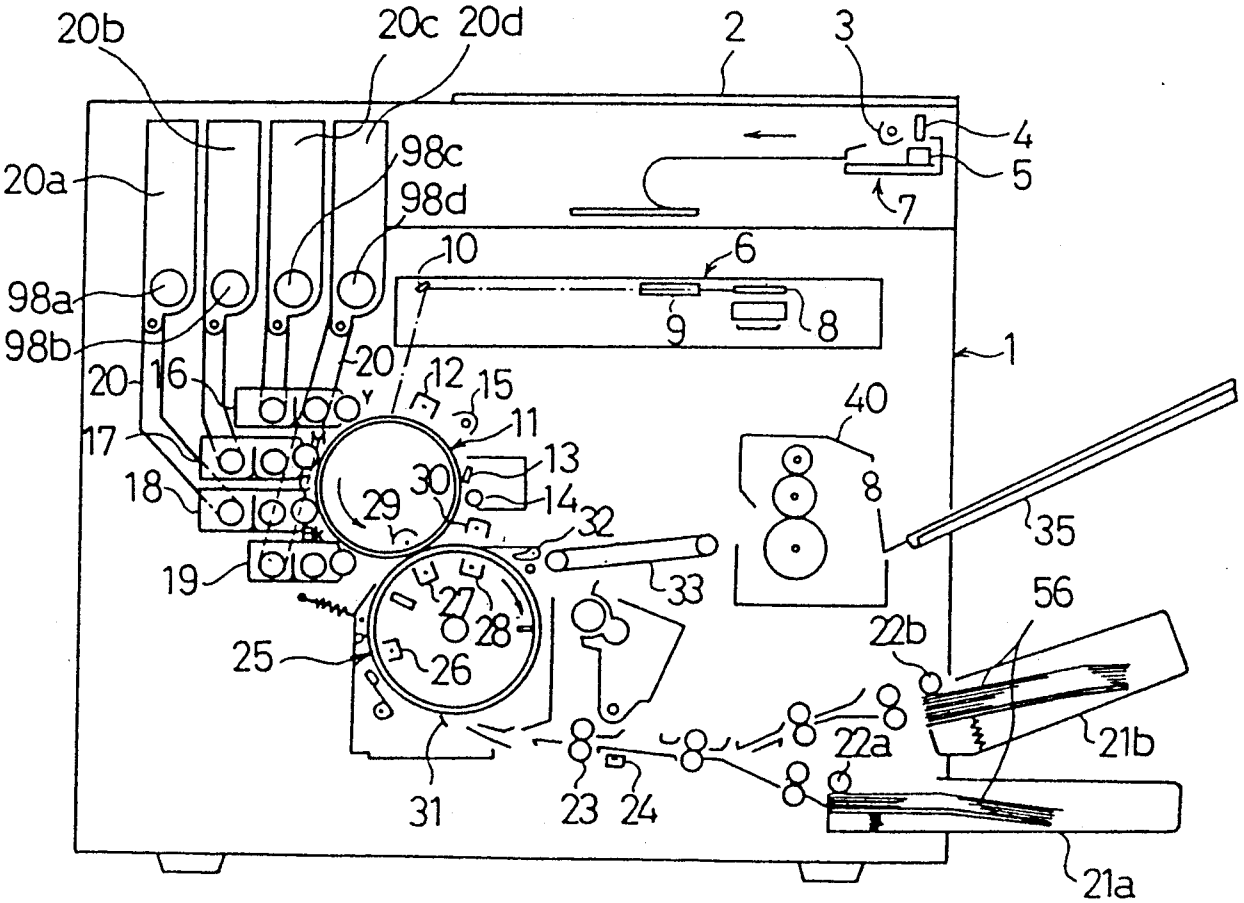
FIG 1 is a schematic constructional view of a color copying machine showing a first embodiment to which the present invention is applied.

FIG. 1 shows a schematic construction of a color copying machine used for a first embodiment to which the present invention is applied.

The copying machine 1 is provided with 4 kinds of developing units. An original placed on an original glass table 2 is projected on a CCD line sensor 5 by an exposure lamp 3 and a lens array 4 and is read as three primary color signals of R (red), G (green) and B (blue). The color signals of R,G,B are converted into 3 or 4 signals of Y (yellow), M (magenta), C (cyan) or with addition of Bk (black) by image processing circuit. The signals are then transmitted to a laser optical system 6 as image signals.

The copying machine which is used in this embodiment is not provided with image memory for three colors. Accordingly, an image reader unit 7 performs scanning every time when each color image is formed based on which of the signals Y,M,C or Y,M,C,Bk are successively transmitted to the laser optical system 6. The laser optical system 6 includes a polygon mirror 8, an f$\theta$ lens 9, a reflector 10 and the like, and irradiates image forming laser beam on each color corresponding to the signals Y, M,C or Y,M,C,Bk to a photoconductive drum 11 for making image exposure.

The photoconductive drum 11 is rotatively driven in the direction of the arrow. The surface of the photoconductive drum 11 is provided with an organic photoconductor laminated on the base plate of a conductor. An organic photoconductor which shows high sensitivity at around 780 nm in laser beam emitting wave length is utilized.

In this embodiment, the photoconductive drum 11 is negatively charged by a charger 12. Around the photoconductive drum 11, a drum cleaner 13, a toner collecting roller 14, an eraser lamp 15 and the charger 12 are disposed with four developing units 16–19 which correspond to said 4 colors. The first developing unit 16 is provided for supplying yellow toner, the second developing unit 17 for magenta toner, the third developing unit 18 for cyan toner and the fourth unit 19 for black toner respectively, and the toner are negatively electrified. The toner replenishment is carried out by properly transporting each colored toner stored in toner hoppers 20*a*–20*d* to developing units 16,17,18,19 corresponding to signals for each colored toner replenishment passing through pipe 20.

A recording member 56 such as ordinary paper and OHP film is loaded in paper cassettes 21*a*,21*b* and transported into the machine one by one by paper feed rollers 22*a*,22*b*. Timing is achieved by temporarily stopping the recording member 56 at the time when the leading end of the recording member comes in contact with a register roller 23, and at the same time, skewing is corrected. The reference numeral 24 designates a paper sensor provided for this purpose.

In the transfer section of the photoconductive drum 11, there is provided a transfer drum 25 which is rotatively driven in the direction of the arrow. In this transfer drum 25, an absorption charger 26, a transfer charger 27 and a separation charger 28 are disposed along the circumferential direction. A transfer charger 29 is arranged in the photoconductive drum 11 opposite to the transfer charger 27, while a separation charger 30 is provided outside the transfer drum 25 opposite to the separation charger 28.

An electrostatic latent image formed on the photoconductive drum 11 by exposure of the laser optical system 6 is visualized as a toner image by one of the developing devices 16–19. On the other hand, the recording member 56 fed from the register roller 23 is held by a clip 31 and absorbed onto the transfer drum 25 with rotation of the photoconductive drum by the absorption charger 26 and is then wound around the transfer drum 25 by rotation. The toner image on the photoconductive drum 11 is transferred onto the recording member 56 while the recording member 56 passes through the transfer chargers 27,29. The recording member 56 is rotated four times by the transfer drum 25 under color mode.

The charge on the recording member 56 which has finished transfer process is eliminated by separation chargers 28,30, and separated by a separating claw 32 from the transfer drum 25 to be transported to a heat fixing unit 40 by a transfer belt 33. The transferred recording member 56 is heated and pressed while passing through the heat fixing unit 40, and an image is fixed on the recording member 56. Thereafter, the recording member 56 is discharged onto a discharge tray 35.

Figure 2:
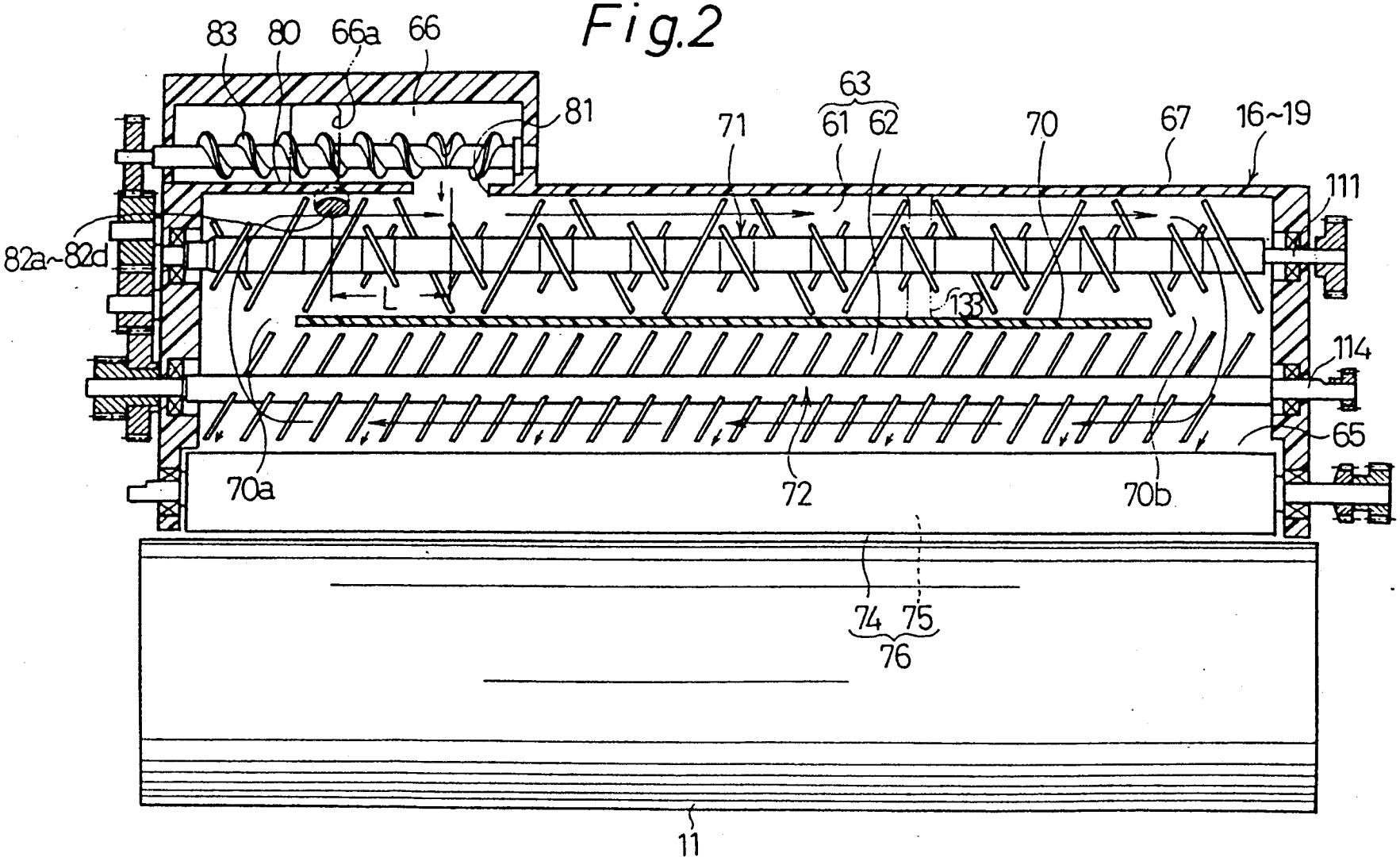
FIG. 2 is a cross sectional view of a developing device in horizontal plane.
Figure 3:
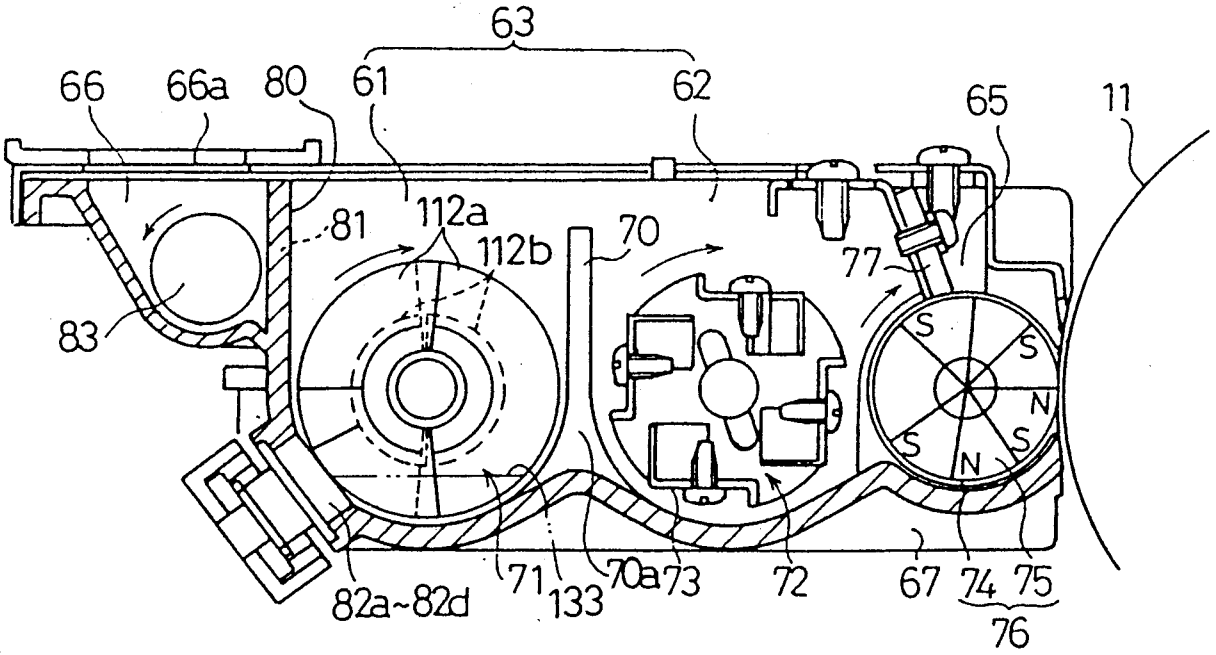
FIG. 3 is a cross sectional view of a developing device in vertical plane.

As illustrated in FIGS. 2 and 3, each developing device 16–19 is provided with a developer transport section 63 for repeatedly circulating and transporting a two-component developer consisted of toner and carrier in the direction of the arrow in FIG. 2 between a transport section 61 and a transport section 62, a developing section 65 for transporting the developer from the transport section 62 in the developer transport section 63 to the photoconductive drum 11, and a toner storing section 66 for replenishing toner to the transport section 61 in the developer transport section 63.

The transport sections 61,62 are provided with tub-shaped transport paths formed on the bottom of a casing 67 and the paths are partitioned by a partition wall 70. However, on the left and right sides of the partition wall 70 in FIG. 2, there are two communicating sections **70*a*,70*b* where the partition wall 70 is not provided through which the transport sections 61 and 62** are communicated with each other in loop.

In the transport section 61, there is provided a stirring transport roller 71 for stirring and transporting developer from left to right side in FIG. 2, while in the transport section 62, there is arranged a stirring transport roller 72 for stirring and transporting the developer from right to left side in FIG. 2. With the rollers 71 and 72, the developer is circulated and transported to the transport sections 61,62 passing through the communicating sections **70*a* and 70*b*. The stirring and transporting roller 72 includes a bucket 73 for transporting the developer being transported in the transport section 62 to the developing section 65**.

The developing section 65 is made of a non-magnetic electric conductor material (for instance, aluminum), and is provided with a developing roller 76 in which a magnetic member 75 is stored in the developing sleeve 74 which receives bias voltage, and a height regulating member 77 for regulating the height of the developer which forms a magnetic brush on the surface of the developing roller 76 by absorption. The developer being transported in the transport path 62 by the stirring and transporting roller 72 is scooped up by the bucket 73 and is supplied to the developing sleeve 74, on the surface of which the developer is held by electrical absorption, and therefore, the developer is transported to the photoconductive drum 11 by rotation in the direction of arrow.

The developer transported thereto forms a magnetic brush along a line of magnetic force formed of different magnetic poles of the magnetic member 75 alternately lined, and frictionally slides along the surface of the photoconductive drum 11 when it passes through the portion opposite to the photoconductive drum 11. At this stage, the toner of the developer in the form of a magnetic brush which frictionally slides along the photoconductor 11 is electrically and strongly absorbed by an electrostatic latent image section which is formed on the photoconductive drum 11 and is electrostatically absorbed to visualize an electrostatic latent image.

After the developing process, the developer is transported back to the developing device side away from the photoconductive drum 11 by faster rotation than that of the developing roller 76. When the developer is transported to the location opposite to the rotative section of the bucket 73, the developer is separated from the surface of the developing sleeve 74 since the same magnetic poles (s) of the magnetic member 75 are lined adjoining each other to form a repellent magnetic field thereat, and it is taken into the developer being transported in the transport section 62 for another transport and circulation again.

Figure 9:
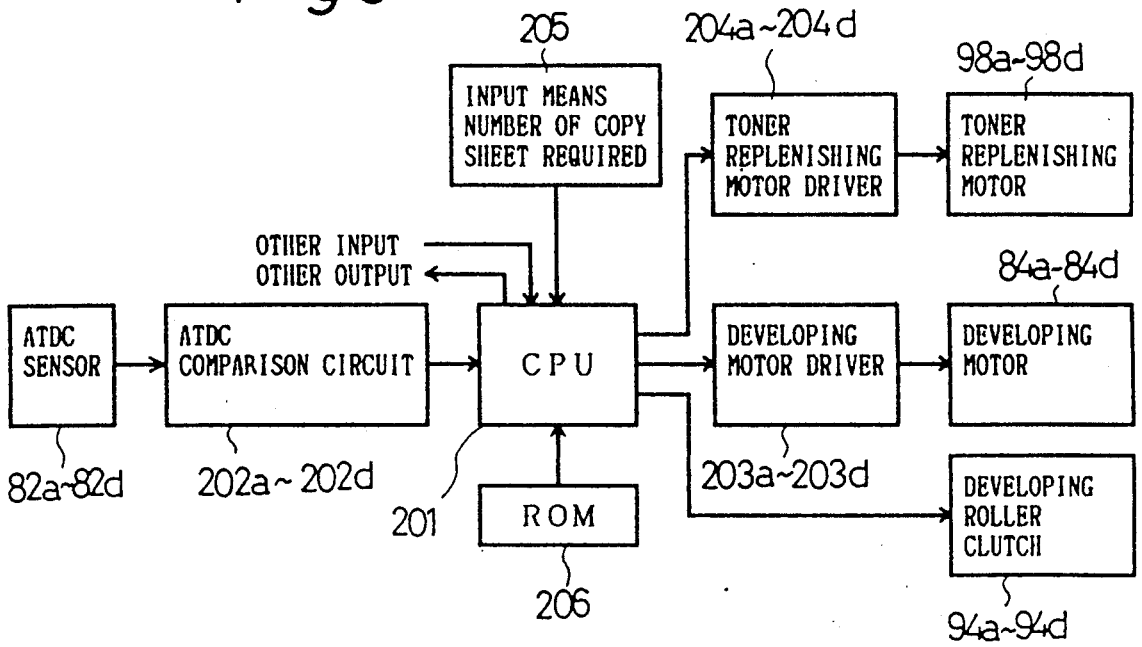
FIG. 9 is a block diagram of a control circuit.
Figure 10:
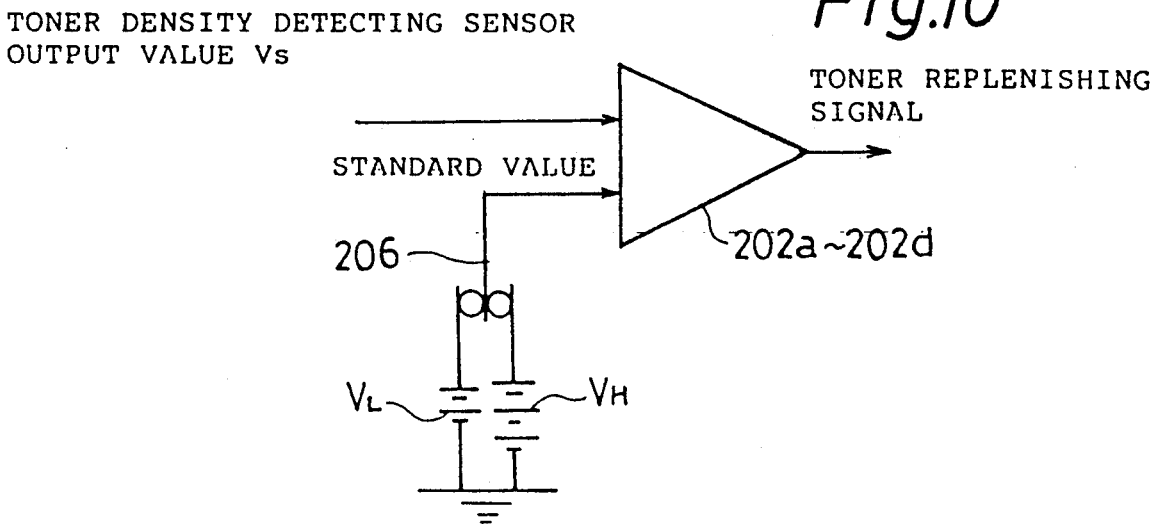
FIG. 10 is a detail view of a comparison circuit for toner replenishment.

The toner storing section 66 for replenishing toner and the transport section 61 are partitioned by partition wall 80 so as to replenish toner from each of the toner hoppers **20*a*–20*d*. A toner replenishing inlet 81 is arranged downstream from the partion wall 80 in the transport section 61, and at a proper upstream position from than the toner replenishing inlet 81, there is arranged toner density detecting sensor 82*a*–82*d* facing from the side of the toner replenishing section 66 toward the transport section 61. The surface of the sensor 82*a*–82*d* is smooth and almost on the same plane with inner surface of the transport section 61. The sensor 82*a*–82*d* detects the toner density of the developer being transported through the transfer section 61 as a variation of magnetic permeability corresponding to the ratio of existence between toner and carrier, and output the detected value to CPU 201, a control section shown in FIG. 9. The CPU 201** is provided for operational control of the copying machine.

As a material of carrier to be used for the developer, magnetic iron powder, ferrite or one coated with resin, or one in which magnetic powder is scattered in resin material or the like is selectively used. In this embodiment, a carrier made from magnetic ferrite (average particle diameter $\phi = 30\ \mu m - 40\ \mu$) coated with acrylic resin is used. As a material of toner, on the other hand, polyester resin based material in an average particle diameter $\phi = 10\ \mu - 15\ \mu$is used. The most suitable mixture ratio of the carrier to toner is 7 wt %–10 wt %.

In the toner storing section 66, there is provided a toner replenishing roller 83 for sending out the toner thrown through a toner receiving inlet **66*a* which is arranged above the storing section 66 to the toner replenishing outlet 81**.

Figure 8:
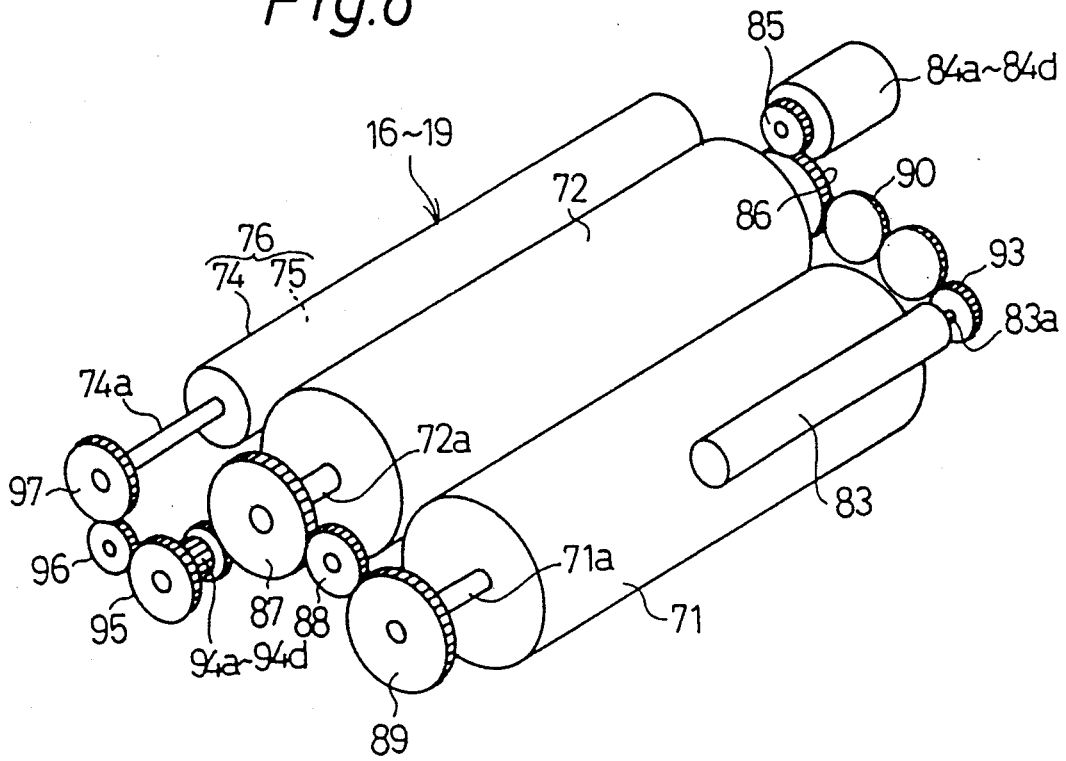
FIG. 8 is a perspective view showing a driving mechanism of a developing device.

As illustrated in FIG. 8, in each developing unit 16–19, the rotation of each developing motor **84*a*–84*d* is transmitted to rotary shaft 72 of the stirring and transporting roller 72 through gears 85 and 86. The rotation of the rotary shaft 72*a* is transmitted to a rotary shaft 71*a* of the stirring and transporting roller 71 through gears 87,88,89. The gear 86 is also connected to a rotary shaft 83*a* of a replenishing roller 83 through gears 90 and 93. Thus, when the motor 84*a*–84*d* is driven, each stirring and transporting roller 71,72 and the replenishing roller 83** are driven simultaneously.

The gear 87 is also connected with a rotary shaft 74*a* of the developing sleeve 74 through one of sleeve clutches 94*a*–94*d* and gears 95,96 and 97. Accordingly, even if the motor 84*a*–84*d* is driven, it is selected whether to drive the developing sleeve 74 depending on whether the clutch 94*a*–94*d* is turned on or not. This is because when the developing unit 16–19 is not used for developing operation, toner replenishing operation is performed by driving the device wherein the developing sleeve is stopped not to perform developing operation.

Each toner hopper 20*a*–20*d* is provided with a replenishing motor 98*a*–98*d*. The replenishing motor 98*c* is actuated when toner density detecting output detected by the toner density detecting sensor 82*a* in the developing unit 16 is below a predetermined value, and the toner in the toner hopper 20*c* is supplied to the toner storing section 66 of the developing unit 16. The toner supplied thereto is then sent out to the transport section 71 through the toner replenishing inlet 81 since the replenishing roller 83 is being rotated in the toner storing section 66.

Other replenishing motors 98*a*,98*b*,98*d* are also actuated corresponding to toner density detection made by respective developing unit 17–19, and the toner in the toner hoppers 20*a*,20*b*,20*d* are properly sent out to supply the toner storing section 66 in the developing unit 17–19.

Figure 11:
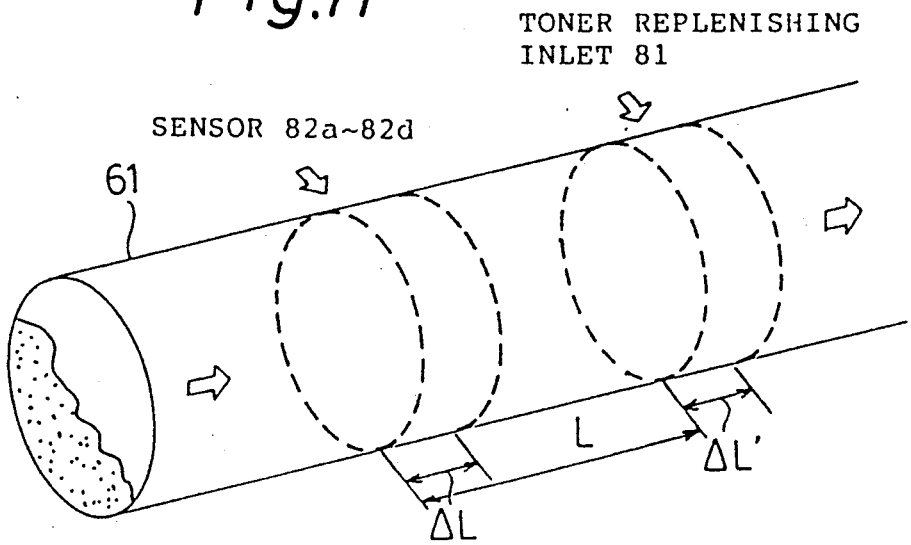
FIG. 11 is an explanatory view showing a condition of movement of developer from a toner density detecting position to a toner replenishing position.

The toner replenishing inlet 81 is arranged downstream side from the toner density detecting sensor 82 with a distance L as shown in FIG. 2. Accordingly, in order to replenish toner to the developer in the portion ΔL in FIG. 11 which is detected below a predetermined value of toner density by the toner density detecting sensor 82*a*–82*d*, it has to be arranged to send out toner into the transport section 71 from the toner replenishing inlet 81. When the developer in the portion ΔL is reached the toner replenishing inlet 81 which is shown by ΔL' in FIG. 11. This timing is made by adjusting the operational timing of the replenishing motor 98*a*–98*d*, that is, by adjusting the timing for starting toner replenishment in view of operational control by the CPU 201.

The toner density detecting ATDC sensor 82*a*–82*d* is, therefore, connected to the CPU 201 through ATDC comparison circuit 202*a*–202*d*, and driver circuit 203*a*–203*d* of the developing motor 84*a*–84*d* and driver circuit 204*a*–204*d* of the replenishing motor 98*a*–98*d* are also connected. Furthermore, a number of copy sheet input means 205, ROM 206 and other input and output for controlling operation of the copying machine 1 are also connected with the CPU 201.

Each rotary blade 112*a*,112*b* provided on rotary shaft 111 in the transport section 61 is, as shown in FIGS. 4 and 5, formed in a semicircular shape a little larger than a semicircle in the circumferential spheres $\theta_1$, $\theta_2$ viewing from the direction of the axes. The rotary blade 112*a* is provided only on one side of the outer circumference of a boss 131 with lead angle $\alpha$. The rotary blade 112*b* is provided on both sides of the outer circumference of boss 132 with lead angle $\beta$ relative to the same direction of rotation. In this embodiment, $\alpha$ is equal to $\beta$, however, it may be changed.

Each rotary blade 112*a*,112*b* is attached around the rotary shaft 111 since the boss 131 and 132 are alternately engaged with the rotary shaft 111 in principle. However, the rotary blade 112*a* is installed with lead $R_1$ in the stirring direction by the lead angle $\alpha$, while the rotary blade 112*b* with lead $R_2$ in the direction of backward flowing.

The number of rotary blades 112*a* is a few, however, as shown in FIGS. 2 and 3, the outer diameter is set a little smaller than the inner diameter of the bottom of transporting section 61 since it strongly transports the developer. With effect of the lead $R_1$ in the transporting direction on all developer in the transport section 61, the developer can be reliably transported. Since the rotary blade 112*a* is provided only on one side of the boss 131, the developer on the other side is freed. On the other hand, the developer on the side of the rotary blade 112*a* is scooped up and stirred while the developer is transported since the rotary blades 112*a* are alternately provided reversely.

The outer diameter of the rotary blade 112*b* is set particularly small compared with the outer diameter of the rotary blade 112*a* as shown in FIGS. 2 and 3, and with function of the lead $R_2$ in the direction of backward flowing on the outer layer of the developer being transported, the developer is caused to flow backward. This action is continuously performed while the rotary shaft 111 is rotated since the blades are provided on both sides of the boss 132, and the outer layer of the developer is reliably and surely flowed backward at the portions where the rotary blades 112*b* are provided without obstructing the flow in the direction of transport of the developer being transported by the blade 112*a*.

The developer which flows backward at each section comes in contact with the developer being stirred and is powerfully transported through the mainstream by the blade 112*a*, and they are mixed or partially replaced to further activate stirring of the whole developer. Accordingly, even when a large amount of toner is required to be replenished because of large consumption of toner for the development of colored images or the like, the toner can be sufficiently stirred when it reaches the position of developing process so that the toner density is unified to avoid an uneven image.

An example of experiment will be shown below.

Rotary Blade 112*a*
Outer Diameter $D_1=32$ mm
Circumferential Sphere $\theta_1 \approx 180°$
Lead Angle $\alpha=30°$
Rotary Blade 112*b*
Outer Diameter $D_2=20$ mm
Circumferential Sphere $\theta_2 \approx 180° \times 2$
Lead Angle $\beta=30°$
Rotary Shaft 111
Number of Revolution: About 200 r.p.m.
Rotary Shaft 114
Number of Revolution: About 200 r.p.m.
Developing Sleeve 74
Number of Revolution: About 200 r.p.m.
Amount of Developer
700–800 g
Ratio: Toner to Carrier
T/C=8 wt %
Ratio: Toner to Polyester
10–12 μm
Ratio: Carrier to Acryl coated Ferrite
30–50 μm
Velocity of One Circulation of Developer
v=30–40 sec.

Satisfactory result has been obtained with the conditions described above.

Means for stirring and transporting the developer in regular direction or in backward direction may be arranged in any construction. For instance, by partially changing the shape in lead section for transporting the developer in regular direction, it may be arranged to form the shape of lead section which possess backward transporting function The ratio for transporting the developer in regular direction and backward direction may variably be set corresponding to situation, and such variation can be set, in the case of said example of experiment, for instance, by freely regulating the sphere and the number of rotary blades 112a,112b, outside Diameters $D_1$,$D_2$, lead angles $\alpha$,$\beta$, outer circumferential sphere $\theta_1$,$\theta_2$ and the like.

As shown by phantom lines in FIGS. 2 and 3, even if a protrusion 133 is arranged to obstruct transportation of the developer being transported in the longitudinal direction of the regular transport path 61, the stirring efficiency is further promoted by the action of the developer obstructed by the protrusion.

In the rotary blade 112a arranged opposite to the sensor 82a–82d, there is formed a developer escaping window 112c as shown in FIGS. 6 and 7, and another rotary blade 112a'' which has no developer escaping window is provided at an upstream position of transporting direction of the rotary blade 112a' with the same phase.

Since the rotary blade 112a' facing the sensor 82a–82d and the rotary blade 112a'' arranged at an upstream position of the blade 112a' are provided in the same phase, they act strongly on the developer being forwarded to the position immediately before the sensor 82a–82d for sending out and passing through the sensor section 82a–82d. However, a part of the developer escapes from the escaping portion since the rotary blade 112a' facing the sensor 82a–82d is provided with the developer escaping window 112c leaving some of the developer at the section where the sensor 82a–82d is provided. Accordingly, the amount of toner remaining thereabout increases more than the developer being transported each transport paths 61,62. The developer in the sensor section 82a–82d is sent out in a fixed amount by the rotary blade 112a' provided with the developer escaping window 112c, while a fixed amount of developer is fed in from immediately before the sensor section 82a–82d by the rotary blade 112a'' which has no developer escaping window. A predetermined amount of developer required for density detection is thus kept in the sensor section 82a–82d by always renewing developer.

Since the rotary blade 112b' provided for backward flowing is positioned immediately of the rotary blade 112a which is provided with the developer escaping window, it causes the amount of developer in the sensor section 82a–82d to be increased by the backward flowing. Furthermore, the action of the developer escaping from the developer escaping window 112c of the rotary blade 112a' in the sensor section 82a–82d serves to stir developer in association with the backward flowing caused by the rotary blade 112b thus further improving the stirring efficiency. The developer escaping window may be arranged, for instance, in a notch shape or any shape may be arranged for leaving a protrusion in view of transport efficiency.

The developer escaping function of the rotary blade 112a' is not limited to said window configuration, it may be arranged to adopt a rotary blade in smaller diameter than the rotary blade 112a so that developer transporting power can be weakened.

In this embodiment, each developing unit 16–19 is successively and selectively used for developing full color images. It is also arranged to be able to stir, transport and replenish toner by driving the developing unit even when it is not being selected for any action. Accordingly, any negative effect on the quality of image caused by a delay in toner density adjustment and insufficient toner stirring can be avoided.

However, excessive toner stirring may cause unsatisfactory electrification and the like since toner is melted and adhered to the surface of carrier thereby worsening the quality of the developer. In order to prevent such trouble, a DC speed control motor is provided for the developing motor 84a–84d, and when the developing unit 16–19 is not used, the motor is controlled to be driven slower than when the developing unit is operated.

Figure 14:
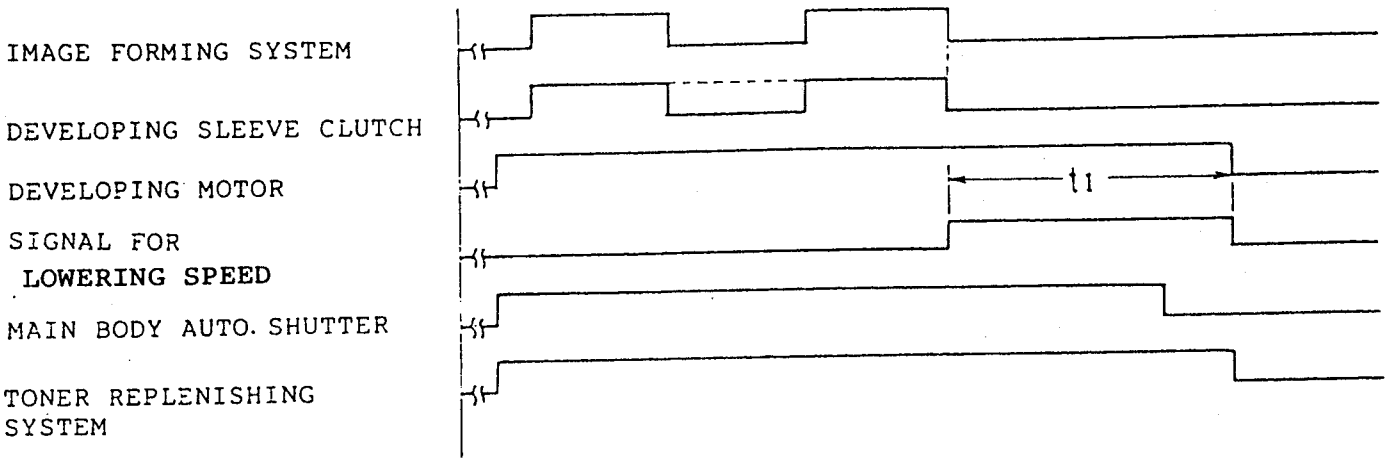
FIG. 14 is a time chart showing a driving control condition of a developing device.

As shown in FIG. 14, this control is made by emitting a signal for lowering speed when the developing sleeve clutch 94a–94d is turned off at the time the developing process is finished for continuing the control for a fixed period of time $t_1$. The time $t_1$ is set irrespective of automatic shutter in the body of the copying machine.

Consequently, the transporting speed of developer in the developing unit 16–19 differs between the time when the developing unit is used and when it is not used. Accordingly, the timing of the developer whose density was detected by the toner density detecting sensor 82a–82d and reaches the toner replenishing inlet 81 is changed. The toner replenishment starting time is, therefore, arranged to be changed simultaneously with the timing when the transporting speed is changed.

Figure 12:
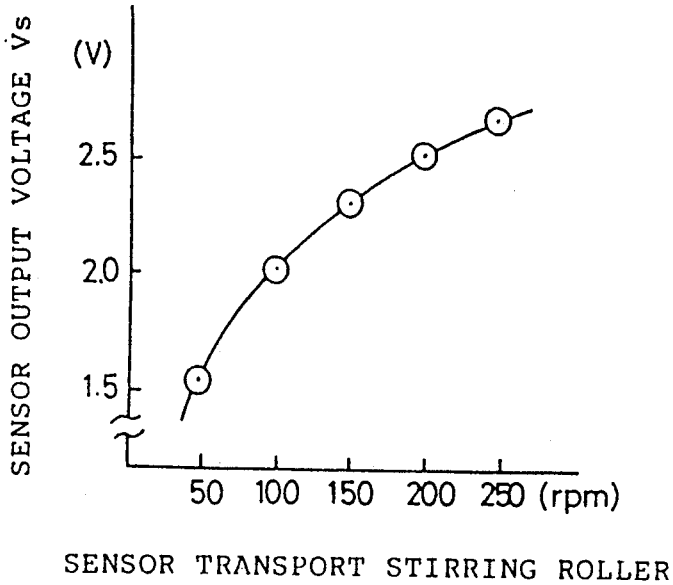
FIG. 12 is a graph showing a relation between sensor output and number of rotations of a stirring and transporting roller in a sensor section.

When the transporting speed is changed, the output level of the sensor 82a–82d is changed even if the toner density is constant. If the transporting speed is higher, the amount of carrier per unit hour which passes through the sensor section 82a–82d is increased even if the toner density is the same thereby strengthening the magnetic effect on the sensor 82a–82d . For instance, the relation between the number of revolutions of the stirring transport roller 71 and sensor output is as shown in FIG. 12, and the sensor output Vs becomes higher if the number of revolutions of the roller 71 is higher.

Figure 13:
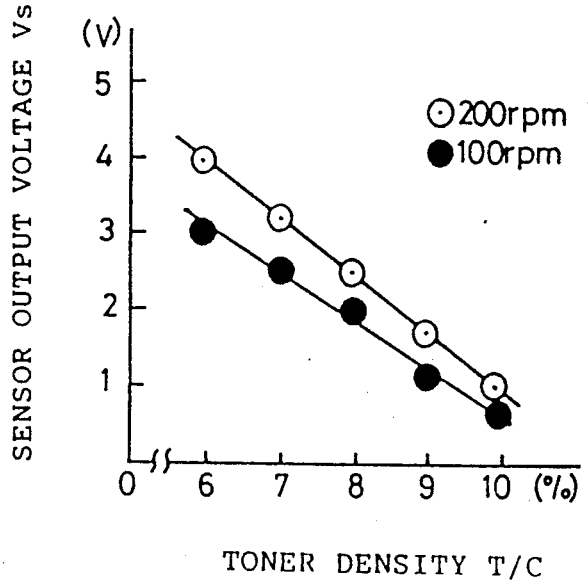
FIG. 13 is a graph showing a relation between toner density and sensor output.

In this embodiment, in case if the number of revolutions is set 200 r.p.m. when the unit is used and 100 r.p.m. when it is not used, the relation between toner density and sensor output is as shown in FIG. 13, and if toner density is low, the output Vs becomes high. Accordingly, even if toner density is the same, at the time of faster transporting speed, the toner density is lowered by the volume the sensor output is risen compared with the time of slower transporting speed when the unit is not operated.

In order to cope with such correlations, comparison circuit 202a–202d is arranged to be variably connected with standard voltage VH against sensor output value $V_s$ at high speed operation and with standard voltage $V_L$ against sensor output value $V_s$ at low speed operation. This switchover process is automatically carried out by a relay contact 206.

Figure 15:
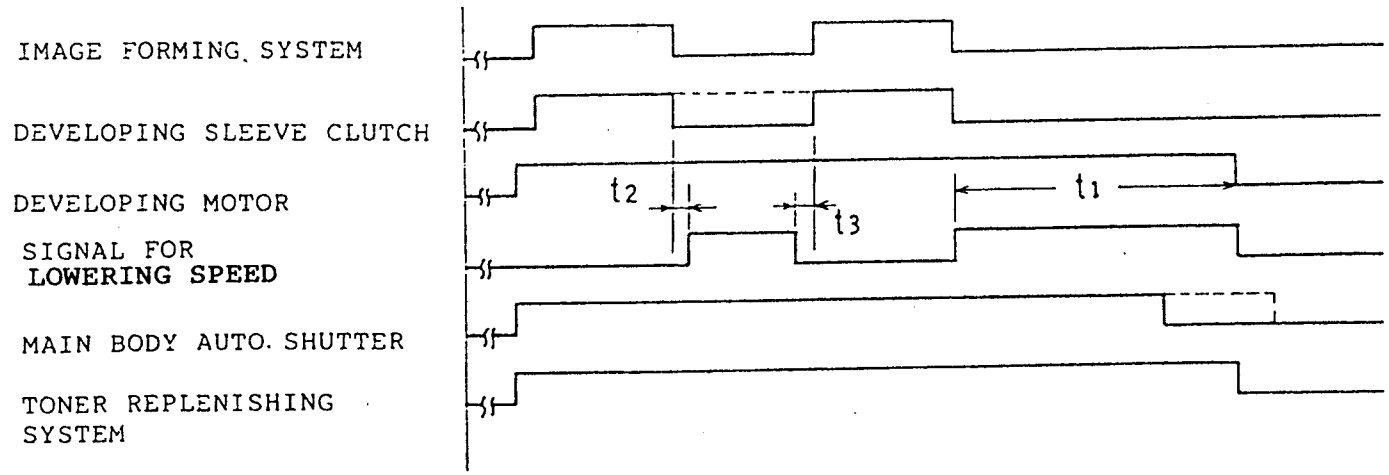
FIG. 15 is a time chart showing an example of variation in the driving control condition of a developing device.

Toner replenishment is conducted every time when toner density is detected below a predetermined value while the developing unit 16–19 is being operated. In case when multi-copying is conducted, as shown in FIG. 15, it may also be arranged to replenish toner by preventing excessive stirring with emission of low speed signal even when the developing unit is not being operated. However, in order not to impair the stability required in high speed transport by such low speed transport, operation is conducted by providing extra time $t_2$,$t_3$ before and after the operation as shown in the figure.

When toner replenishment is conducted based on the density detection of a visual image formed on the photoconductive drum, if the density of the visual image is below a predetermined value, toner has to be replenished to the developer which was at the specified portion when detection was made. Accordingly, in this case also, the toner replenishment start timing has to be adjusted so as to replenish toner at the time when the developer which was at the specified portion passes the toner replenishing inlet.

Not limited to a color copying machine, said toner replenishing method is applicable to a machine which is provided with two or more developing units. The developing unit is also capable of readily adjusting visual image density by changing developing speed. In this case, it is only necessary to change toner replenishment start timing corresponding to transport speed since the developer transporting speed is changed. It is preferred to stop the rotation of the developing sleeve when the developing unit is not being operated but is driven at low speed since wasteful consumption and overflowing of toner can be prevented, however, it is not necessarily required.

Figure 16:
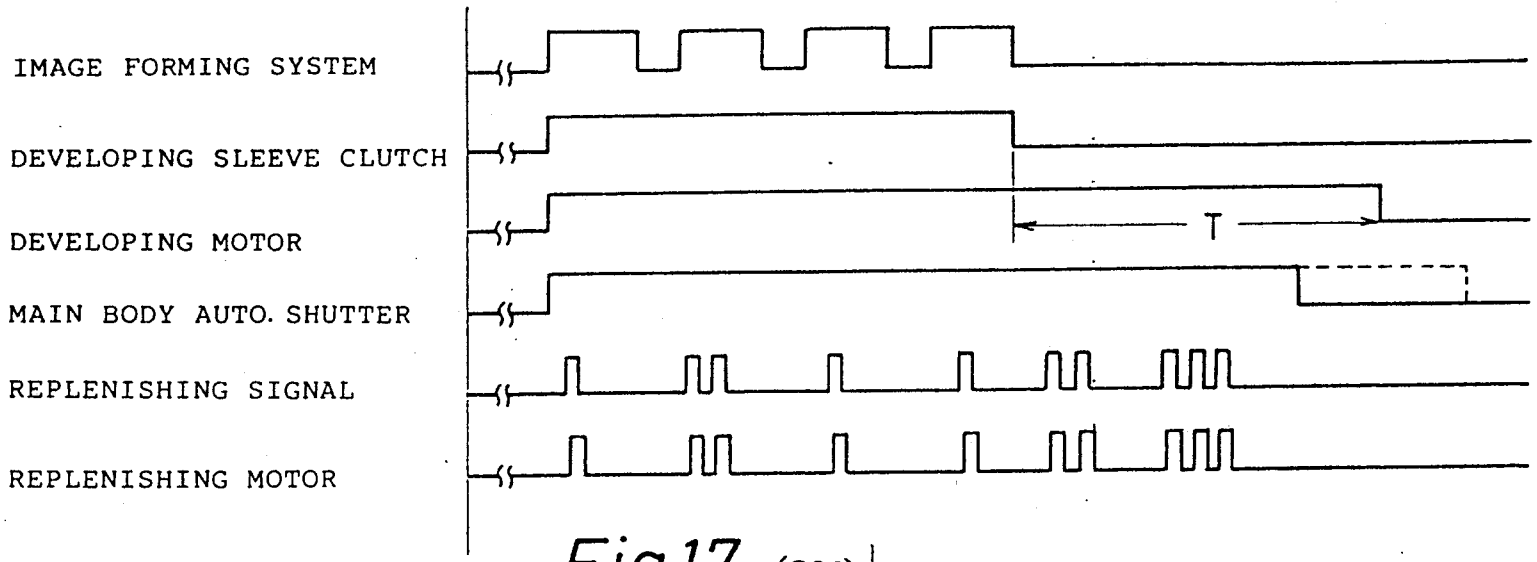
FIG. 16 is a time chart showing a driving control condition of a developing device in a second embodiment of the present invention.
Figure 17:
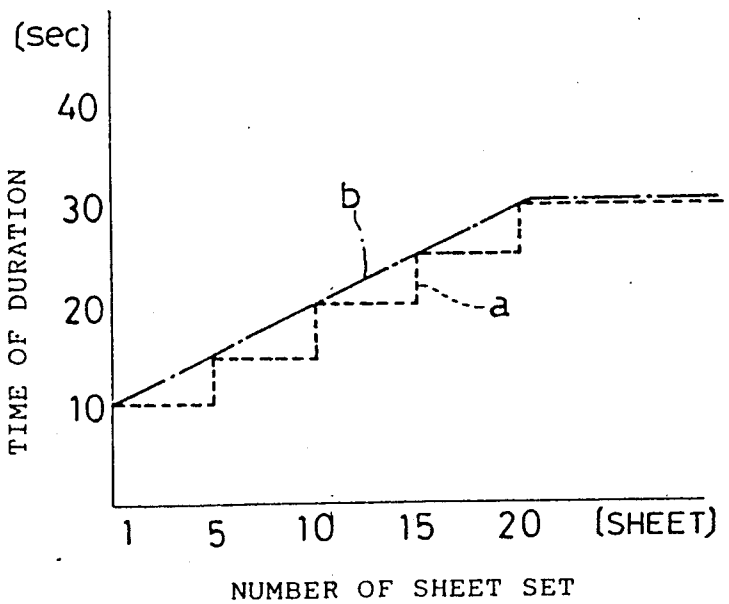
FIG. 17 is a graph showing a condition for time distribution of duration of time in control mode of the present embodiment against the number of copy sheets.

FIGS. 16 and 17 show a second embodiment of the present invention. In this embodiment, when each developing unit 16–19 is selectively used corresponding to requirement, the developing unit is utilized for image forming operation for the number of sheets set by a plurality of numbers of copy sheet input means 205 (refer to FIG. 9).

As shown in FIG. 16, a toner replenishing signal is emitted corresponding to the output of sensor 82*a*–82*d* even under a developing operation, and corresponding replenishing motor 98*a*–98*d* is driven to replenish toner. The toner replenished is readily stirred since the developing unit is being driven, and toner density of developer is made uniform with sufficient electrification.

The developing motor 84*a*–84*d* keeps on driving for the period T corresponding to the number of copy paper even if the development for a predetermined number of sheets is finished, and toner replenishment is performed corresponding to the output of the sensor 82*a*–82*d*. By making use of the time when the developing unit 16–19 is not used, it may be prepared for recovering a uniform and predetermined density of developer and also for sufficient electrification.

The toner is replenished and stirred while the developer has made one round of circulation in the developing unIt 16–19 and toner density of the whole developer is adjusted.

For conducting toner replenishment and stirring when the developing unit is not used, required time of duration for toner replenishing control mode corresponding to the number of sheets to be copied is previously stored in the ROM 206 (refer to FIG. 9) as shown by a line in FIG. 17, however, the required maximum time is set within a range that the developer makes one round of circulation.

As shown by line b in FIG. 17, it may be arranged to increase time of duration every time the number of sheets is increased one by one. The time of duration is set irrespective of the automatic shutter in the copying machine 1, and it is set every time when each developing unit 16–19 has finished its selective use.

When toner replenishment is conducted based on the density detection of a visual image formed on the photoconductive drum; if the density of the visual image is below a predetermined value, toner has to be replenished to the developer which was at the specified portion when detection was made. Accordingly, in this case also, the toner replenishment start timing has to be adjusted so as to replenish toner at the time when the developer which was at the specified portion passes the toner replenishing inlet.

Not limited to a color copying machine, the above toner replenishing method is preferably applicable to an apparatus which has two or more developing devices which can be selectively used.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device for use in an electrophotographic image forming apparatus, comprising:

a developer holding member for supplying developer being rotatively driven and held for development of an electrostatic latent image;

a developer transporting means, by which the developer supplied to a developing unit is circulated and transported while being stirred and mixed by rotation, and said developer is supplied to the developer holding member in transit;

a driving means for driving the developer transporting means; and a driving signal supply means for supplying driving signals to the driving means differentially in order to set the developer transporting means in different driving conditions when the developing unit is operated and when it is not operated for developing process.

2. The developing device as defined in claim 1, wherein the driving signal supply means supplies a first signal for rotating the developer transporting means at a first speed when the developing unit is operated for development and a second signal for rotating the developer transporting means at a second speed which is a little slower than the first speed when the developing unit is not operated for developing process.

3. A developing device for use in an electrophotographic image forming apparatus, comprising:

a developer holding member for supplying developer being rotatively driven and held for development of an electrostatic latent image;

a developer transporting means, by which the developer supplied to a developing unit is circulated and transported while being stirred and mixed by rotation, and said developer is supplied to the developer holding member in transit;

a driving means for driving the developer transporting means;

a driving signal supply means for supplying driving signals to the driving means differentially in order to set the developer transporting means in different driving conditions when the developing unit is operated and when it is not operated for developing process;

a toner replenishment signal generating means for generating a toner replenishment signal corresponding to the result of comparison wherein comparison is made between toner density detected and toner density standard value upon detecting toner density of the developer in the developing unit;

a toner replenishing means for replenishing new toner to the developer transporting means corresponding to the toner replenishing signal; and a toner density standard value changeover means for changing over the toner density standard value corresponding to the driving condition of the developer transporting means.

4. The developing device as defined in claim 3, wherein the driving signal supply means supplies a first signal for rotating the developer transporting means at a first speed when the developing unit is operated for development and a second signal for rotating the developer transporting means at a second speed which is a little slower than the first speed when the developing unit is not operated for developing process, while the toner density standard value changeover means changes over either to a first toner density standard value which is used during developing operation or to a second toner density standard value which is used when developing process is not being performed.

5. The developing device as defined in claim 4, wherein the toner replenishment signal generating means detects toner density by a magnetic sensor, and the toner density standard value changeover means lowers the second toner density value to a value less than the first toner density standard value.

6. The developing device as defined in claim 4, wherein the toner replenishing means replenishes toner either by a first timing when it has received a toner replenishing signal during developing operation or by a second timing which is slower than the first timing when it has received a toner replenishing signal when developing process is not being performed.

7. The developing device as defined in claim 1, wherein the developing device has a plurality of developing units for selective use and each one of the units are operationally controlled by driving means provided with each developing unit.

8. A developing device for use in an electrophotographic image forming apparatus, comprising:

a developer holding member for supplying developer being rotatively driven and held for development of an electrostatic latent image;

a developer transporting means, by which the developer supplied to a developing unit is circulated and transported while being stirred and mixed by rotation, and said developer is supplied to the developer holding member in transit;

a toner replenishing means for replenishing new toner to the developer transporting means; and a control means having a first toner replenishing mode for replenishing toner, wherein after a predetermined number of developing operations has been completed, toner density in the developing unit is detected and the toner replenishing means is then actuated corresponding to the toner density detected by continuously operating the developer transporting means for the period set by said predetermined number of developing operations.

9. The developing device as defined in claim 8, wherein the developing device has a plurality of developing units for selective use and the first toner replenishing mode performs toner replenishment under the condition where image forming operation is suspended.

10. The developing device as defined in claim 9, wherein the first toner replenishing mode performs toner replenishment under the condition where image forming operation is suspended on completion of image formation for the number of sheets selected.

11. The developing device as defined in claim 10, wherein the time of duration for the first toner replenishing mode is changed corresponding to the number of sheets set.

12. The developing device as defined in claim 8, wherein the developer holding member is stopped when the first toner replenishing mode is suspended.

13. The developing device as defined in claim 12, wherein the control means has a second toner replenishing mode for detecting toner density in the developing unit during developing operation and for actuating the toner replenishing means corresponding to the toner density detected.

14. The developing device as defined in claim 12, wherein the developing device has a plurality of developing units and each developing unit is operationally controlled by a driving means provided with each developing unit.

15. A developing device for use in an electrophotographic image forming apparatus, comprising:

a casing for storing developer;

a developer holding member extending in one direction in the casing for holding developer on its surface and for supplying the developer for development of electrostatic latent image by rotation; and a developer transporting means for transporting the developer in the casing along said direction while mixing and stirring the developer and supplying it to the developer holding member in transit, wherein the developer transporting means is provided with a first transporting member for transporting the developer with transporting force in said one direction and a second transporting member for transporting the developer with transporting force in reverse direction to said one direction.

16. The developing device as defined in claim 15, wherein the proper number of the first and second transporting members are alternatively disposed along said one direction and the transporting force of the first transporting member is stronger than that of the second transporting member.

17. The developing device as defined in claim 16, wherein the first transporting member and the second transporting member are arranged on one side of a rotary shaft in a manner to be tilted with a lead angle in opposite directions relative to the same direction of rotation.

18. The developing device as defined in claim 17, wherein the first transporting members are disposed at odd number positions on one side of the rotary shaft relative to said one direction, while the members are arranged at even number positions on the other side of the rotary shaft, and the second transporting members are disposed on both sides of the rotary shaft in every section between which the first transporting members are disposed.

19. The developing device as defined in claim 16, wherein each of the first and second transporting members are made of a plate in the shape of semicircle.

20. A developing device for use in an electrophotographic image forming apparatus, comprising:

a casing for storing developer;

a developer holding member extending in one direction in the casing for holding the developer on its surface, and supplying the developer for development of electrostatic latent image by rotation;

a developer transport path having a developer transporting means for transporting the developer in the casing along said one direction while mixing and stirring the developer and supplying it to the developer holding member in transit;

a toner density detecting means provided in a midway point of the developer transporting path for detecting toner density of the developer being transported, wherein the developer transporting means comprises a first transporting member disposed at a location opposite to the toner density detecting means and a plurality of transporting members including a second transporting member which is arranged upstream in the developer transporting direction relative to the first transporting member, and the transporting force of the first transporting member is weaker than that of the second transporting member.

21. The developing device as defined in claim 20, wherein the developer transporting area of the first transporting member is smaller than that of the second transporting member.

22. The developing device as defined in claim 21, wherein the developer transporting means has a rotary shaft extending along said one direction, and each of the first and second transporting members are arranged around the rotary shaft at a position where they will be in the same phase so as to be tilted with a predetermined lead angle.

23. The developing device as defined in claim 22, wherein transporting members other than the first and second transporting members are disposed around the rotary shaft extending along said one direction, and they comprise a third transporting member which has transporting force the same as that of the second transporting member in the same direction of the first and second transporting members and a fourth transporting member which has weaker transporting force than that of the third transporting member in the reverse direction.

24. The developing device as defined in claim 23, wherein the first, second, third and fourth transporting members are disposed on one side of the rotary shaft in a manner to be tilted with a lead angle in opposite directions relative to the same direction of rotation.

25. The developing device as defined in claim 24, wherein the first and third transporting members are disposed at odd number positions on one side of the rotary shaft to said one direction, while the first and third transporting members are arranged at even number positions on the other side of the rotary shaft, and the fourth transporting members are disposed on both sides of the rotary shaft in every section between which the first and third transporting members are disposed.

26. The developing device as defined in claim 25, wherein each of the first, second, third and fourth transporting members are made of a plate substantially in the shape of semicircle.

27. The developing device as defined in claim 26, wherein the first transporting member has a smaller developer transporting area than that of the second transporting member since the first transporting member is partially hollowed out.

28. The developing device as defined in claim 23, wherein one of the fourth transporting members is disposed immediately downstream in the developer transporting direction of the first transporting member.

* * * * *

UNITED STATES PATENT AND TRADEMARK OFFICE

CERTIFICATE OF CORRECTION

PATENT NO. : 5,005,517

DATED : April 9, 1991

INVENTOR(S) : Kazuyuki Fukui, et al

It is certified that error appears in the above-identified patent and that said Letters Patent is hereby corrected as shown below:

At col. 1, line 41, delete "to".

At col. 1, line 55, after "and", insert --this--.

At col. 5, line 66, after "of", insert --the--.

At col. 6, line 30, delete "than".

At col. 6, line 44, after "one", insert --of them--.

At col. 6, line 48, change "-40μ" to -- -4μm--.

At col. 6, line 51, change "10μ-15μ" to --10μm-15μm--.

At col. 7, line 29, after "arranged", insert --on the--.

At col. 9, line 53, after "immediately", insert --downstream--.

Signed and Sealed this

Seventeenth Day of November, 1992

*Attest:*

DOUGLAS B. COMER

*Attesting Officer*

*Acting Commissioner of Patents and Trademarks*